US008801451B2

(12) United States Patent
Muro

(10) Patent No.: US 8,801,451 B2
(45) Date of Patent: Aug. 12, 2014

(54) CONNECTOR

(75) Inventor: Takashi Muro, Makinohara (JP)

(73) Assignee: Yazaki Corporation, Tokyo (JP)

( * ) Notice: Subject to any disclaimer, the term of this patent is extended or adjusted under 35 U.S.C. 154(b) by 34 days.

(21) Appl. No.: 13/807,785

(22) PCT Filed: Jun. 28, 2011

(86) PCT No.: PCT/JP2011/064788

§ 371 (c)(1),
(2), (4) Date: Dec. 31, 2012

(87) PCT Pub. No.: WO2012/002376

PCT Pub. Date: Jan. 5, 2012

(65) Prior Publication Data

US 2013/0102180 A1 Apr. 25, 2013

(30) Foreign Application Priority Data

Jul. 2, 2010 (JP) ..... 2010-151726

(51) Int. Cl.
*H01R 4/50* (2006.01)

(52) U.S. Cl.
USPC ..... 439/345

(58) Field of Classification Search
USPC ..... 439/345, 595, 746, 744, 748, 353–357
See application file for complete search history.

(56) References Cited

U.S. PATENT DOCUMENTS 3,982,805 A * 9/1976 Irie ..... 439/595
4,969,841 A 11/1990 Sueyoshi et al.
5,601,454 A 2/1997 Suzuki et al.
5,651,700 A * 7/1997 Sato et al. ..... 439/595
5,749,753 A * 5/1998 Chishima et al. ..... 439/752.5
6,626,701 B2 9/2003 Yoshida et al.
6,669,507 B2 12/2003 Yamanashi et al.
7,867,028 B2 * 1/2011 Brown ..... 439/595
2001/0003686 A1 6/2001 Yoshida et al.
2002/0151215 A1 10/2002 Yamanashi et al.

FOREIGN PATENT DOCUMENTS

JP 2126376 U 10/1990
JP 831493 A 2/1996
JP 2001167833 A 6/2001
JP 2002313472 A 10/2002
JP 2007266011 A 10/2007
JP 2009117379 A 5/2009

OTHER PUBLICATIONS

International Search Report dated Aug. 2, 2011 issued in International Application No. PCT/JP2011/064788 (PCT/ISA/210).
Written Opinion dated Aug. 2, 2011 issued in International Application No. PCT/JP2011/064788 (PCT/ISA/237).

* cited by examiner

*Primary Examiner* — Jean F Duverne
(74) *Attorney, Agent, or Firm* — Sughrue Mion, PLLC

(57) ABSTRACT

A connector includes a terminal, a connector housing to which the terminal is inserted, and a lance provided inside the connector housing. When the terminal is inserted, the lance comes into sliding contact with the terminal, thereby being bent, and a locking portion of the lance returned by elasticity is engaged with an engaging portion of the terminal, whereby the terminal is prevented from falling out toward the rear side. At a lateral side portion of the lance, a protruding piece is provided, and at a side edge in the width direction of a peripheral wall of a box portion of the terminal, a rib is provided. When the terminal is inserted, before the peripheral wall of the box portion comes into sliding contact with the engaging portion of the lance, the rib comes into sliding contact with the protruding piece, thereby bending the lance.

3 Claims, 4 Drawing Sheets

(a)

(b)

(a)

(b)

CONNECTOR

TECHNICAL FIELD

The present invention relates to a connector which includes a terminal having a square tubular portion at its front end, a connector housing to which the terminal is inserted and fixed, and a flexible lance which is provided inside a terminal accommodating chamber of the connector housing.

BACKGROUND ART

An example of this kind of terminals is disclosed in Patent Literature 1. FIG. 3 is a perspective view illustrating the external appearance of a terminal which is a component of a connector disclosed in Patent Literature 1, and FIG. 4(*a*) and FIG. 4(*b*) illustrates a state at each insertion position when the terminal of FIG. 3 has been inserted in a terminal accommodating chamber of a connector housing.

A terminal 120 as shown in FIG. 3 has a square tubular portion 121 which is provided at its front end and is surrounded by a peripheral wall 121*a*, and a conductor-connectable portion 122 and a cover-connectable portion 123 for an electric wire which are provided at its rear end. The box portion 121 is a portion for receiving a male terminal of a mating connector, and has a spring piece (not shown) which is provided therein and fixes the received male terminal in cooperation with the peripheral wall 121*a* of the box portion. Further, at the front end of the box portion 121, a protruding portion 125 made by folding is provided, and at the read end of the protruding portion 125, an engaging portion 126 which is engaged with a lance to be described below is provided. The front end of the protruding portion 125 is a portion which collides with the lance, first of all, when the terminal 120 is inserted, and has a curved surface for making contact on the lance smoothly.

In a case of assembling the terminal 120 with a connector housing, thereby constructing a connector, the terminal 120 attached to the front end of the electric wire is inserted from the rear end of a terminal accommodating chamber 111 of a connector housing 110 into the terminal accommodating chamber, as shown in FIG. 4(*a*). Inside the terminal accommodating chamber 111 of the connector housing 110, a lance 116 which is flexible in a direction (a vertical direction in FIG. 4(*a*) or FIG. 4(*b*)) intersecting with the insertion direction of the terminal 120 is provided, and the front end portion of the lance 116 is composed of a locking portion 116*c* which is engaged with the engaging portion 126 of the terminal 120.

Then, when the terminal 120 is inserted from the rear end of the terminal accommodating chamber 111, first, as shown in the lower stage of FIG. 4(*a*), the protruding portion 125 of the box portion 121 of the inserted terminal 120 contacts on the lance 116. When the terminal 120 is further inserted, the protruding portion 125 comes into sliding contact with the lance 116 such that the lance 116 is bent downward, as shown in the upper stage of FIG. 4(*a*). When the terminal 120 is inserted still further to reach a predetermined position, as shown in the upper and lower stages of FIG. 4(*b*), the protruding portion 125 passes through the position of the lance 116, and at this stage, the lance 116 returns from the bent state to the original position such that the front end portion (the locking portion 116*c*) of the lance 116 is engaged with the engaging portion 126 on the rear side of the protruding portion 125 of the terminal 120. As a result, the terminal 120 is fixed so as not to fall out toward the rear side. Further, the entire terminal 120 is inserted and fixed, whereby the connector is constructed.

CITATION LIST

Patent Literature

Patent Literature 1: JP-A-2007-266011

SUMMARY OF INVENTION

Technical Problem

However, in the above-mentioned connector according to an example of the related art, when the terminal 120 is inserted in the terminal accommodating chamber 111, the front end portion (the locking portion) of the lance 116 comes directly into sliding contact with the peripheral wall 121*a* of the box portion 121. For this reason, in a case where there is the protruding portion 125 or a recess (not shown) at the peripheral wall 121*a*, an insertion feeling gets worse and insertion resistance increases.

The present invention is made in view of the above-mentioned circumferences, and an object of the present invention is to provide a connector capable of reducing a terminal inserting force while preventing a terminal inserting feeling from getting worse even in a case where there is irregularity at a peripheral wall of a box portion.

Solution to Problem

The above-mentioned object of the present invention is achievable by the following configurations.

(1) A connector, including: a terminal having a square tubular box portion which is provided at a front end of the terminal and is surrounded by a peripheral wall; and a connector housing to which the terminal is inserted and fixed, wherein a lance is provided inside a terminal accommodating chamber of the connector housing, the lance having a locking portion which is flexible in a direction intersecting with an insertion direction of the terminal to be engaged with an engaging portion provided at the peripheral wall or an extension part of the box portion, and when the terminal is inserted from a rear end of the terminal accommodating chamber, the lance comes into sliding contact with the inserted terminal, thereby being bent, and at a stage where the terminal is inserted up to a predetermined position, the locking portion of the lance returned from a bent state is engaged with the engaging portion of the terminal, whereby the terminal is prevented from falling out toward the rear side, wherein a protruding piece is provided at a lateral side of the lance, and a rib is provided at a side edge in a width direction of the peripheral wall of the box portion of the terminal, and when the terminal is inserted into the terminal accommodating chamber, the rib comes into sliding contact with the protruding piece, thereby bending the lance before the peripheral wall of the box portion comes into the sliding contact with the locking portion of the lance.

(2) The connector according to the above (1), wherein the rib is provided as an inverse-insertion preventing portion for being not interfered with the connector housing, thereby allowing the insertion of the terminal when the insertion direction of the terminal into the terminal accommodating chamber is proper, and for being interfered with the connector housing, thereby blocking the insertion of the terminal when the insertion direction of the terminal is improper.

(3) The connector according to the above (1) or (2), wherein the rib is provided continuously from a front end of the box portion of the terminal to a portion right before the engaging portion, and a guide portion is provided at a corner portion of the front end of the rib for making contact of the rib on the protruding piece smoothly, and a lead portion is provided at a corner portion of a rear end of the rib to smoothly release the sliding contact of the rib and the protruding piece and lead the locking portion of the lance toward the engaging portion, thereby making their engagement smooth.

According to the connector having the configuration of (1), when the terminal is inserted into the terminal accommodating chamber, the protruding piece provided at the lateral side portion of the lance comes into sliding contact with the rib of the terminal, but the locking portion of the lance does not come into sliding contact with the peripheral wall of the box portion of the terminal. Therefore, even if there is irregularity at the peripheral wall of the box portion, it is possible to prevent a terminal inserting feeling from getting worse due to the influence of the irregularity, and to reduce an inserting force when the terminal is inserted.

According to the connector having the configuration of (2), the rib is provided as a piece for preventing the terminal from being inserted inversely. Therefore, it is possible to prevent the terminal from being inserted inversely (for example, upside down state).

According to the connector having the configuration of (3), the rib is provided continuously from the front end of the box portion to a portion right before the engaging portion, the guide portion is provided at the corner portion of the front end of the rib, and the lead portion is provided at the corner portion of the rear end of the rib. Therefore, it is possible to reduce the resistance when the rib starts to contact on the protruding piece of the lance, by the action of the guide portion, and the operation when the protruding piece of the lance finishes the sliding contact with the rib of the terminal and the locking portion of the lance is engaged with the engaging portion of the terminal is smoothly performed by the action of the lead portion, whereby the terminal inserting feeling is improved.

MODES FOR CARRYING OUT INVENTION

Hereinafter, an embodiment of the present invention will be described with reference to the drawings.

Figure 1:
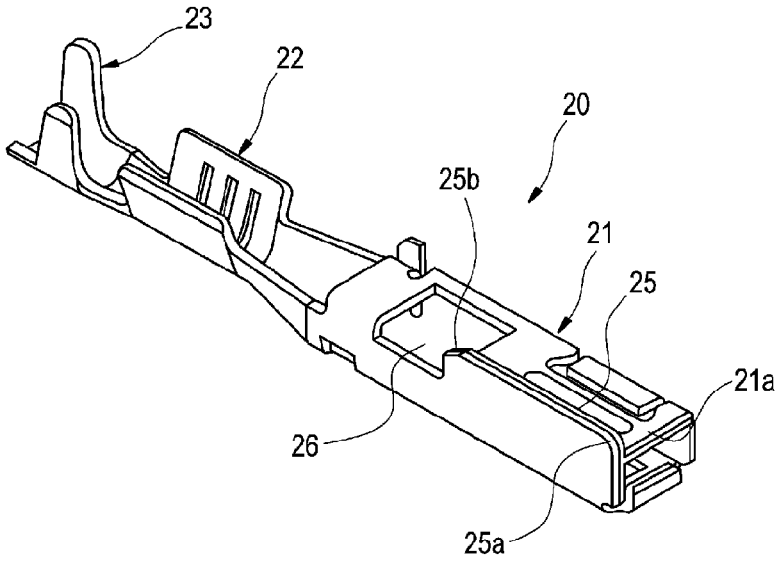
FIG. 1 is an explanatory diagram of components of a connector according to an embodiment of the present invention, in which FIG. 1(*a*) is a perspective view illustrating the external appearance of a terminal, and FIG. 1(*b*) is a perspective view of a lance provided in a terminal accommodating chamber of a connector housing.
Figure 1:
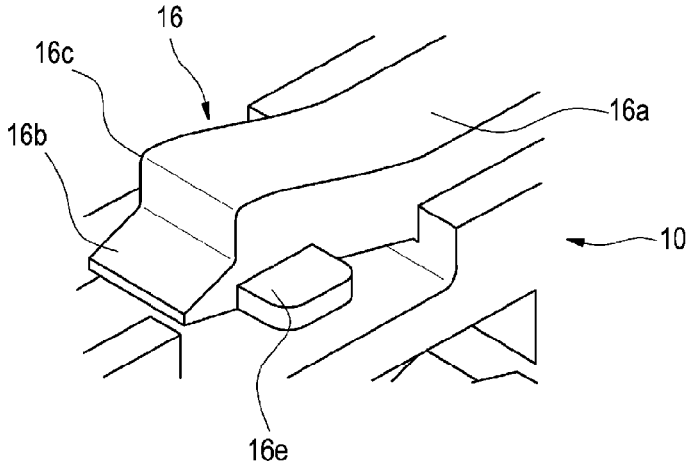
Figure 2:
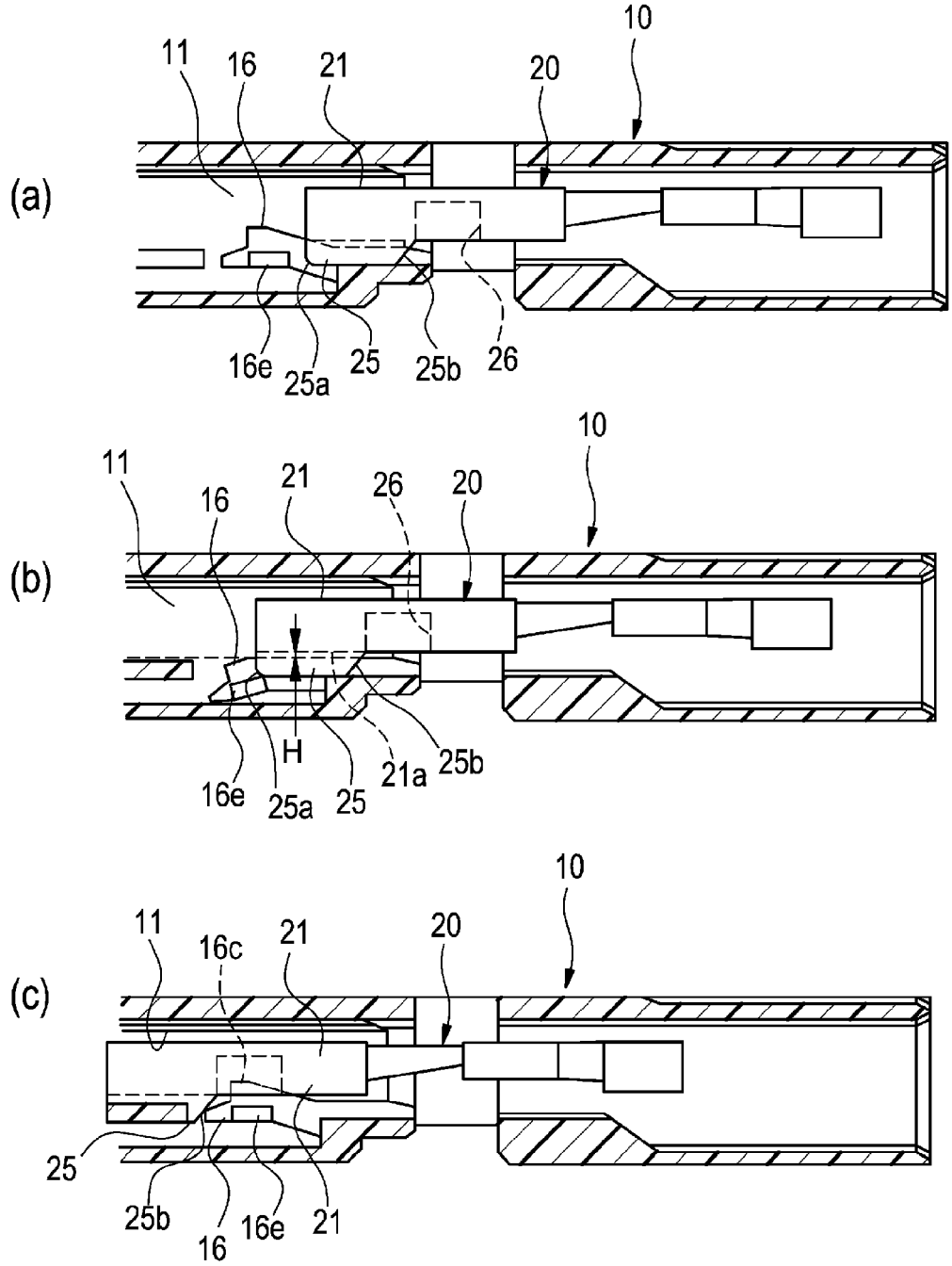
FIG. 2 is an explanatory diagram of actions during assembling of the connector according to the embodiment, in which FIG. 2(*a*) is a sectional side view schematically illustrating a state at a beginning of insertion when the terminal is inserted into the terminal accommodating chamber of the connector housing, FIG. 2(*b*) is a sectional side view schematically illustrating a state at a mid-stage of the insertion when a rib of the terminal starts to be in sliding contact with a protruding piece of a lance due to further insertion of the terminal, and FIG. 2(*c*) is a sectional side view schematically illustrating an insertion completion state when the sliding contact of the rib of the terminal and the protruding piece of the lance has finished, and a locking portion of the lance has been engaged with an engaging portion of the terminal, whereby the terminal has been fixed.
Figure 3:
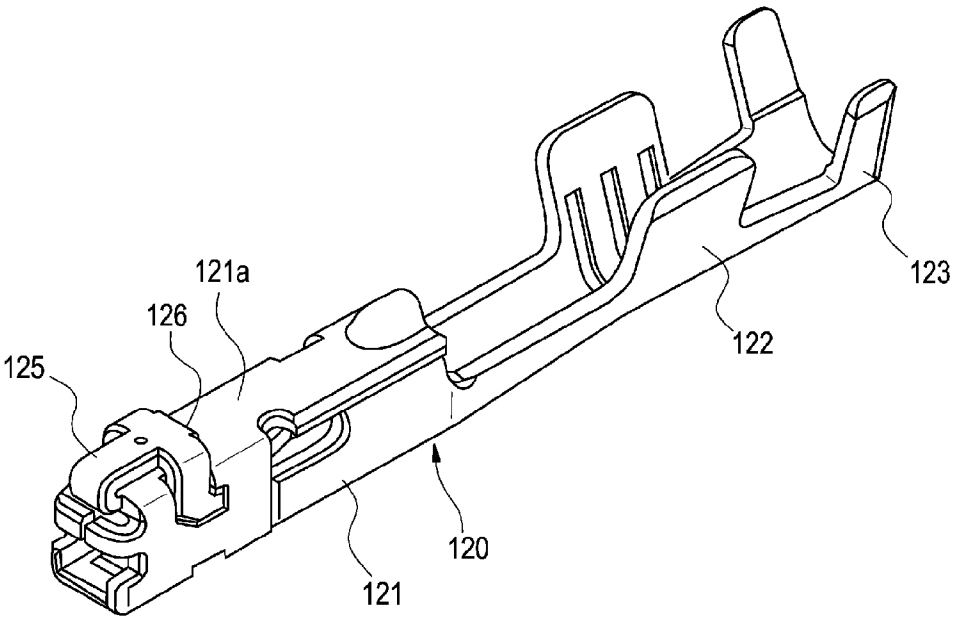
FIG. 3 is a perspective view illustrating the external appearance of a connector of an example according to the related art.
Figure 4:
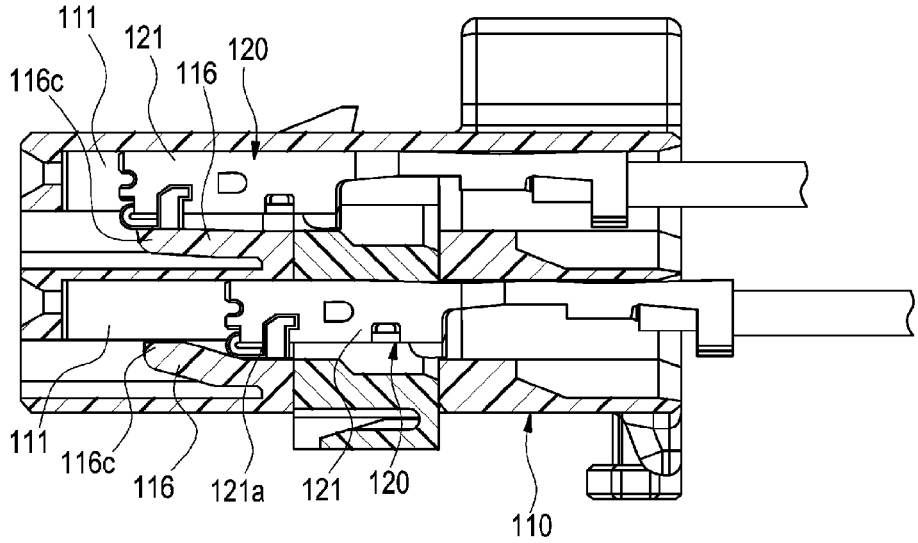
FIG. 4 illustrates a state at each insertion position when the terminal of FIG. 3 has been inserted in a terminal accommodating chamber of a connector housing, in which the bottom of FIG. 4(*a*) is a sectional side view illustrating a state at a beginning of the insertion, the top of FIG. 4(*a*) is a sectional side view illustrating a state at a mid-stage of the insertion, and the top and bottom of FIG. 4(*b*) are sectional side views illustrating a state during insertion completion.
Figure 4:
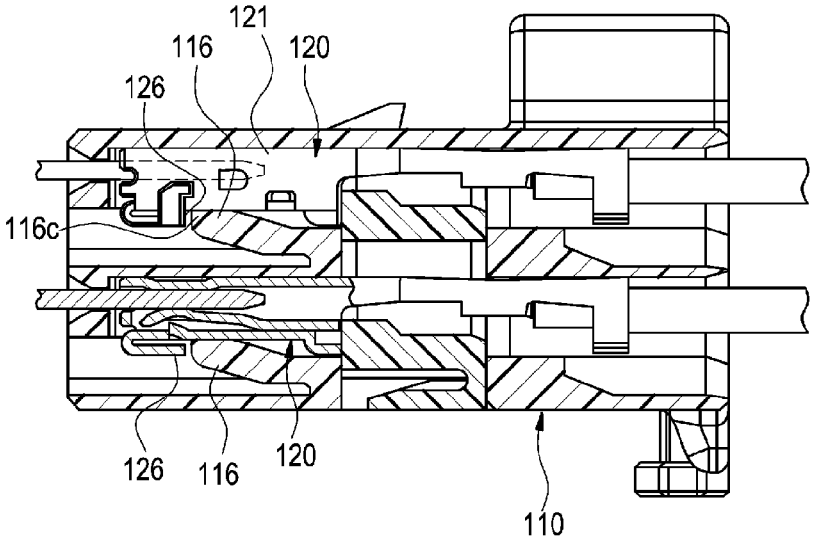

FIG. 1 is an explanatory view of components of a connector according to an embodiment, in which FIG. 1(*a*) is a perspective view illustrating the external appearance of a terminal, FIG. 1(*b*) is a perspective view of a lance provided in a terminal accommodating chamber of a connector housing, and FIG. 2(*a*) to FIG. 2(*c*) are explanatory diagrams of actions during assembling of the connector.

A connector according to the embodiment includes a terminal 20 and a connector housing 10. The terminal 20 includes a square tubular portion 21 which is provided at the front end of the terminal 20 and is surrounded by a peripheral wall 21*a*, and a conductor-connectable portion 22 and a cover-connectable portion 23 for an electric wire which are provided at the rear end of the terminal 20, as shown in FIG. 1(*a*). The connector housing 10 is made by resin molding, and the terminal 20 is inserted from the rear end of the connector housing 10 into the connector housing 10 and is fixed to the connector housing 10, as shown in FIG. 2(*a*) to FIG. 2(*c*).

The box portion 21 at the front end of the terminal 20 is a portion for receiving a male terminal of a mating connector, and has a spring piece (not shown) which is provided therein and fixes the received male terminal in cooperation with the peripheral wall 21*a* of the box portion 21.

Inside a terminal accommodating chamber 11 of the connector housing 10, a lance 16 which is flexible in a direction (a vertical direction in FIG. 2(*a*) to FIG. 2(*c*)) intersecting with the insertion direction of the terminal 20 is provided. As shown in FIG. 1(*b*), the lance 16 includes a rear end 16*a* to be fixed to the inner wall of the terminal accommodating chamber 11, a front end 16*b* serving as a free end, and a locking protrusion 16*c* which is provided on a side of the terminal insertion passage in the vicinity of the front end 16*b* serving as a free end and is engaged with an engaging recess 26 provided at the peripheral wall 21*a* of the box portion 21.

Also, at a side portion of the lance 16, a blade-like protruding piece 16*e* is provided. Further, of side edges in the width direction of the peripheral wall 21*a* of the box portion 21 of the terminal 20, at a side edge corresponding to the protruding piece 16*e* of the lance 16 during insertion of the terminal 20, a rib 25 is provided to protrude. When the terminal 20 is inserted into the terminal accommodating chamber 11, before the peripheral wall 21*a* of the box portion 21 comes into sliding contact with the locking protrusion 16*c* of the lance 16, the rib 25 comes into sliding contact with the protruding piece 16*e* provided at the side portion of the lance 16, thereby bending the lance 16.

The rib 25 is provided as a piece for preventing the terminal 20 from being inserted inversely, and is provided continuously from the front end of the box portion 21 to a portion right before the engaging recess 26. When the insertion direction of the terminal 20 into the terminal accommodating chamber 11 is proper, the rib 25 serving as an inverse-insertion preventing piece does not interfere with the connector housing 10, thereby allowing the insertion of the terminal 20.

Meanwhile, when the insertion direction of the terminal 20 is improper, the rib 25 interferes with the connector housing 10, thereby blocking the insertion of the terminal 20.

At the front end corner portion of the rib 25, a guide portion 25*a* composed of a curved surface portion for making contact of the rib 25 on the protruding piece 16*e* smoothly is provided. Further, at the rear end corner portion of the rib 25, a lead portion 25*b* composed of a chamfered portion is provided to smoothly release the sliding contact with the protruding piece 16*e* of the lance 16 and lead the locking protrusion 16*c* of the lance 16 toward the engaging recess 26, thereby making their engagement smooth.

In a case of assembling the terminal 20 with the connector housing 10, thereby constructing a connector, the terminal 20 attached to the front end of the electric wire is inserted into the terminal accommodating chamber 11 of the connector housing 10 from its rear end, as shown in FIG. 2(*a*). When the terminal 20 is inserted from the rear end of the terminal accommodating chamber 11, the lance 16 comes into sliding contact with the inserted terminal 20, thereby being bent downward.

In this case, before the peripheral wall 21*a* of the box portion 21 of the terminal 20 comes into contact with the locking protrusion 16*c* of the lance 16, the rib 25 of the terminal 20 contacts on the protruding piece 16*e* of the lance 16, and in a state where a gap H between the peripheral wall 21*a* of the box portion 21 and the locking protrusion 16*c* of the lance 16 is kept as shown in FIG. 2(*b*), according to the insertion of the terminal 20, the rib 25 and the protruding piece 16*e* come into sliding contact with each other.

Then, when the terminal 20 is inserted still further to reach the predetermined position, at this stage, as shown in FIG. 2(*c*), the lance 16 returns from the bent position to the original position, and the locking protrusion 16*c* of the returned lance 16 is engaged with the engaging recess 26 of the terminal 20, whereby the terminal 20 is fixed so as not to fall out toward the rear side. When the entire terminal 20 is inserted, the connector is constructed.

Like this, in the connector of the present embodiment, when the terminal 20 is inserted into the terminal accommodating chamber 11, the protruding piece 16*e* provided at the side portion of the lance 16 comes into sliding contact with the rib 25 of the terminal 20, and the locking protrusion 16*c* of the lance 16 does not come into sliding contact with the peripheral wall 21*a* of the box portion 21 of the terminal 20 with the gap H. Therefore, even in a case where there is irregularity at the peripheral wall 21*a* of the box portion 21, it possible to prevent the inserting feeling of the terminal 20 from getting worse due to the influence of the irregularity, and to reduce an inserting force when the terminal 20 is inserted.

Further, the rib 25 is provided continuously from the front end of the box portion 21 to a portion right before the engaging recess 26, the guide portion 25*a* is provided at the front end corner portion of the rib 25, and the lead portion 25*b* is provided at the rear end corner portion of the rib. Therefore, it is possible to reduce the resistance when the rib 25 starts to contact on the protruding piece 16*e* of the lance 16, by the action of the guide portion 25*a*, and the operation when the protruding piece 16*e* of the lance 16 finishes the sliding contact with the rib 25 of the terminal 20 and the locking protrusion 16*c* of the lance 16 is engaged with the engaging recess 26 of the terminal 20 is smoothly performed by the action of the lead portion 25*b*, whereby the inserting feeling of the terminal 20 is improved.

Also, according to the present embodiment, the rib 25 is provided as a piece for preventing the terminal from being inserted inversely. Therefore, it is possible to prevent the terminal 20 from being inserted inversely (for example, inversely in a vertical direction).

The present invention is not limited to the above-mentioned embodiment, but can be appropriately modified and improved. Further, the material, shape, dimensions, number, disposition place, and the like of each component of the above-mentioned embodiment are arbitrary as long as the present invention can be achieved, and are not limited.

For example, according to the above-mentioned embodiment, the engaging recess 26 is provided on the peripheral wall 21*a* of the box portion 21. However, a step portion at the rear end of the box portion 21 may be used as an engaging portion.

Although the present invention has been described in detail or with reference to a specific embodiment, it is apparent to those skilled in the art that it is possible to add various changes or modifications without departing from the sprit and scope of the present invention.

The present application is based on Japanese Patent Application (Patent Application No. 2010-151726) filed on Jul. 2, 2010, the contents of which are incorporated herein by reference.

INDUSTRIAL APPLICABILITY

According to the present invention, even in a case where there is irregularity at the peripheral wall of a box portion of a terminal, it is possible to prevent a terminal inserting feeling from getting worse due to the influence of the irregularity, and to reduce an inserting force when the terminal is inserted.

Reference Signs List

10 CONNECTOR HOUSING
11 CONNECTOR ACCOMMODATING CHAMBER
16 LANCE
16*c* LOCKING PROTRUSION (LOCKING PORTION)
16*e* PROTRUDING PIECE
20 TERMINAL
21 BOX PORTION
21*a* PERIPHERAL WALL
25 RIB (INVERSE-INSERTION PREVENTING PIECE)
26 ENGAGING RECESS (ENGAGING PORTION)

The invention claimed is:

1. A connector, comprising:

a terminal having a square tubular box portion which is provided at a front end of the terminal and is surrounded by a peripheral wall; and a connector housing to which the terminal is inserted and fixed, wherein a lance is provided inside a terminal accommodating chamber of the connector housing, the lance having a locking portion which is flexible in a direction intersecting with an insertion direction of the terminal to be engaged with an engaging portion provided at the peripheral wall or an extension part of the box portion, and when the terminal is inserted from a rear end of the terminal accommodating chamber, the lance comes into sliding contact with the inserted terminal, thereby being bent, and at a stage where the terminal is inserted up to a predetermined position, the locking portion of the lance returned from a bent state is engaged with the engaging portion of the terminal, whereby the terminal is prevented from falling out toward the rear side, wherein a protruding piece is provided at a lateral side of the lance, and a rib is provided at a side edge in a width direction of the peripheral wall of the box portion of the terminal, and when the terminal is inserted into the terminal accommodating chamber, the rib comes into sliding contact with the protruding piece, thereby bending the lance before the peripheral wall of the box portion comes into the sliding contact with the locking portion of the lance.

2. The connector according to claim 1, wherein:

the rib is provided as an inverse-insertion preventing portion for being not interfered with the connector housing, thereby allowing the insertion of the terminal when the insertion direction of the terminal into the terminal accommodating chamber is proper, and for being interfered with the connector housing, thereby blocking the insertion of the terminal when the insertion direction of the terminal is improper.

3. The connector according to claim 1, wherein:

the rib is provided continuously from a front end of the box portion of the terminal to a portion right before the engaging portion, and a guide portion is provided at a corner portion of the front end of the rib for making contact of the rib on the protruding piece smoothly, and a lead portion is provided at a corner portion of a rear end of the rib to smoothly release the sliding contact of the rib and the protruding piece and lead the locking portion of the lance toward the engaging portion, thereby making their engagement smooth.

* * * * *